US005709305A

United States Patent [19]

Essig et al.

[11] Patent Number: 5,709,305

[45] Date of Patent: Jan. 20, 1998

[54] DISPENSER FOR SOLID PHARMACEUTICAL PREPARATIONS

[75] Inventors: Dieter Essig, Bad Kreuznach; Heribert Häusler, Klein-Winternheim; Hans-Dieter Ruthemann, Gau-Algesheim; Klaus-Dieter Eckert, Aepfingen; Frank Landwehr, Hochdorf; Thomas Zimmer, Harxheim; Dieter Berndt; Thomas Reiner, both of Berlin-Zehlendorf; Günter Horntrich; Reiner Reeg, both of Pforzheim, all of Germany

[73] Assignee: Boehringer Ingelheim GmbH, Ingelheim am Rhein, Germany

[21] Appl. No.: 569,090

[22] PCT Filed: Jun. 3, 1994

[86] PCT No.: PCT/EP94/01796

§ 371 Date: May 28, 1996

§ 102(e) Date: May 28, 1996

[87] PCT Pub. No.: WO94/29191

PCT Pub. Date: Dec. 22, 1994

[30] Foreign Application Priority Data

Jun. 14, 1993 [DE] Germany ..... 43 19 609.8

[51] Int. Cl.[6] ..... B65D 83/00

[52] U.S. Cl. ..... 206/536; 206/540

[58] Field of Search ..... 206/528, 535, 206/536, 533, 540, 470, 538

[56] References Cited

U.S. PATENT DOCUMENTS

| | | | |
|---|---|---|---|
| 3,397,774 | 8/1968 | Tjaden | 206/470 |
| 4,502,612 | 3/1985 | Morrison | 206/540 X |
| 4,573,581 | 3/1986 | Galloway et al. | 206/535 X |

*Primary Examiner*—Jacob K. Ackun

*Attorney, Agent, or Firm*—Robert P. Raymond; Alan R. Stempel; Mary-Ellen Devlin

[57] ABSTRACT

A new dispenser for solid pharmaceutical preparations consists of a flat container with a removal well 3 which can be closed or opened by the flipping round of a closure member 5 with a convexity 6 engaging in the removal well 3.

4 Claims, 3 Drawing Sheets

FIG. 1.
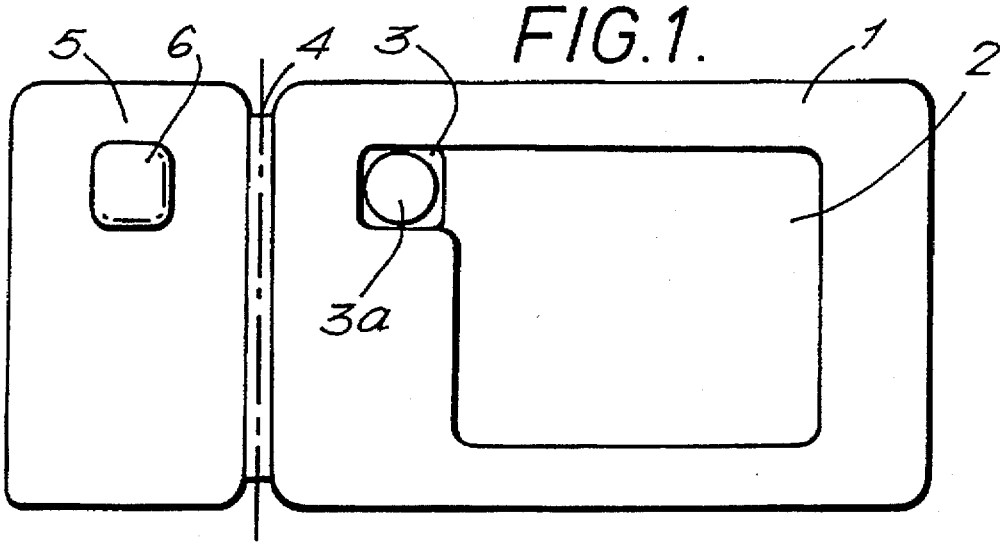
FIG. 1a.
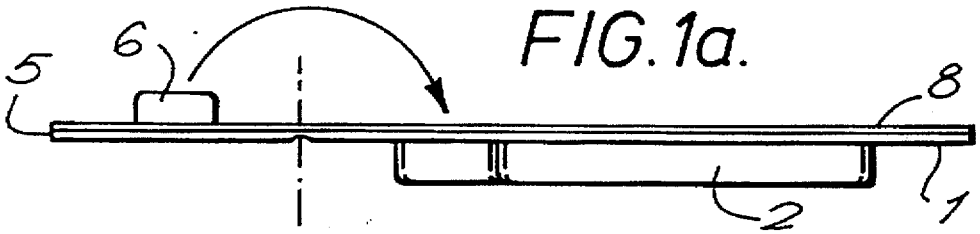
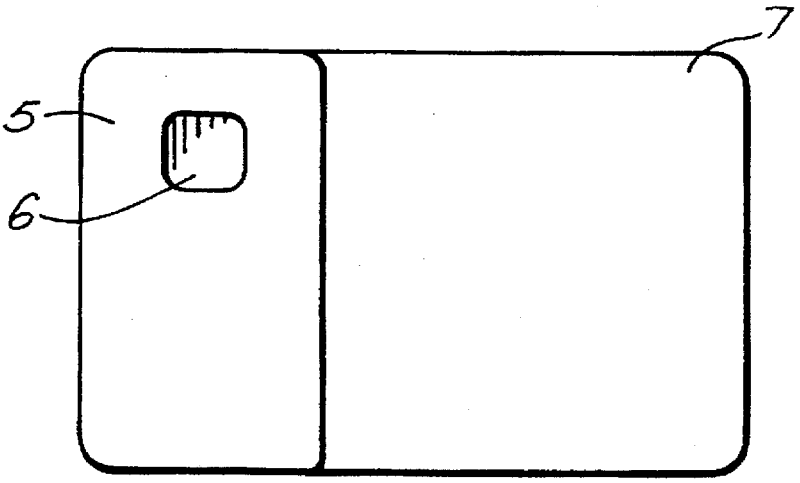
FIG. 2.
FIG. 3.
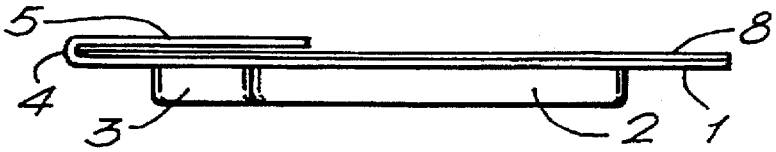

DISPENSER FOR SOLID PHARMACEUTICAL PREPARATIONS

FIELD OF INVENTION

The invention relates to a dispenser for solid pharmaceutical preparations, particularly tablets, film-coated tablets, sugar-coated tablets and capsules.

BACKGROUND OF THE INVENTION

Solid pharmaceutical preparations such as tablets, film-coated tablets, sugar-coated tablets, capsules, and suppositories have hitherto generally been packaged in bottles, press-out packs, glass or plastics tubes or boxes.

The invention now solves the problem of providing a simple, easy to handle package of a suitable form, the construction of which uses little material.

SUMMARY OF THE INVENTION

The new dispenser consists of a flat container in which, at one narrow end, there is a through opening which communicates with a removal well closed off by a flap closure.

Some embodiments of the invention and appropriate modifications and details are shown in FIGS. 1–7.

BRIEF DESCRIPTION OF THE DRAWINGS

FIG. 1 shows a view of a dispenser according to the invention in the flipped open state. In a plate 1 is a flat tray 2 which merges into a removal well 3 at one side. Adjoining the plate 1 is a foldline 4 which makes it easier to fold the closure member 5 round. The closure member 5 has a convexity 6 shaped so that when it is folded round it engages in the removal well 3 and substantially fills said well. Mounted on the plate 1 is a planar cover plate which totally covers the plate 1, apart from the place where the removal well 3 is located (shown here with a tablet 3*a* therein). Over the removal well 3 the cover plate has a cutout; it allows the convexity 6 to pass through under slight pressure, and the closure member 5 is then fixed on the cover plate by a clamping connection.

FIG. 1*a* is a side view of the dispenser according to FIG. 1 showing the cover plate 8 pulled over the closure member 5.

Figure 4:
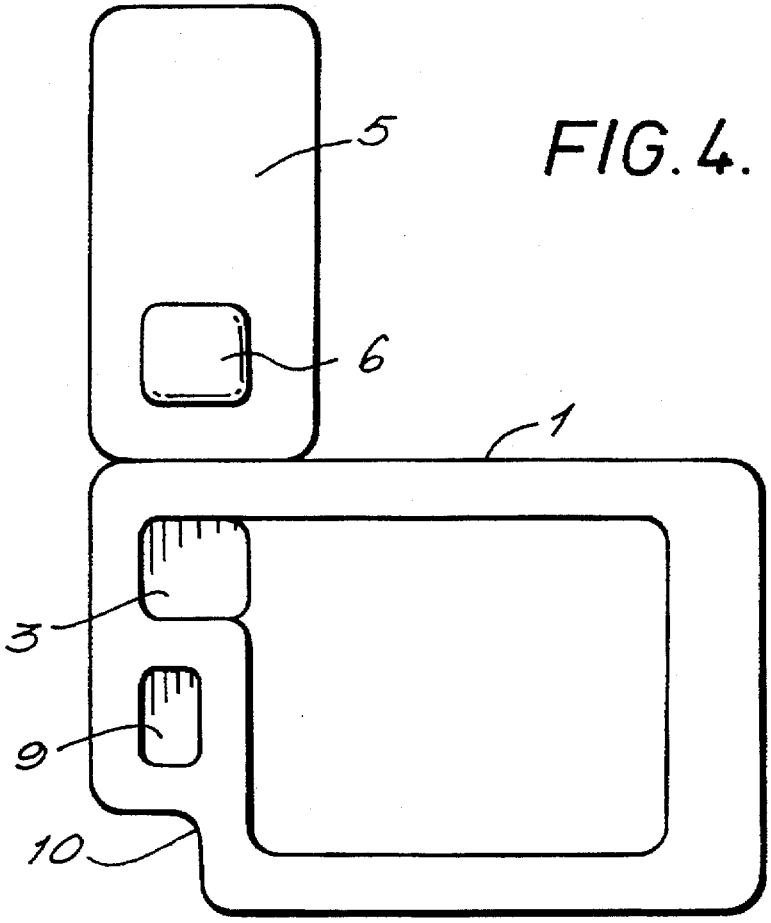

The height of the tray 2 depends on the nature and quantity of the filling. As a rule, a height which is slightly greater than the thickness of the individual pharmaceutical preparations, eg. tablets, is sufficient. If several layers of pharmaceutical preparations are to be accommodated one above the other, a correspondingly deeper tray will be used.

FIG. 2 is a view of the closed dispenser from above, the closure member 5 abutting tightly on the cover plate whilst the convexity 6 has protruded into the cutout of the cover plate and the removal well 3.

FIG. 3 shows the dispenser viewed from the longer narrow side. The flat tray 2 with the adjacent removal well 3 can be seen under the plate 1. The closure member 5 has been folded round the foldline 4 and abuts tightly on the cover plate 8. Next to the closure member 5 which has been folded round, there is room on the cover plate 8 for instructions for use. In order to open the dispenser the closure member 5 is lifted on the side opposite the foldline 4. By tilting the dispenser so that, the removal well is in a lower position, or by gently shaking it, one item of the contents is conveyed into the removal well 3 from where it can be removed. The dispenser is then closed again.

In the dispenser according to FIG. 4 the closure member 5 is secured with a narrow side on the plate 1. The latter has an additional depression 9; this serves to store half a tablet, for example. This may be desirable if the contents of the package consists of divisible tablets, of which the patient requires only half. A recess 10 in the plate 1 and the cover plate 8 makes it easier to flip open the closure member 5.

Figure 5:
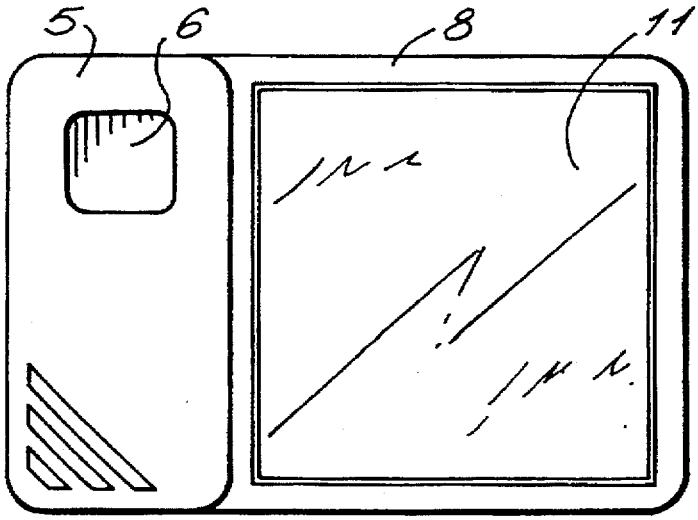

FIG. 5 shows the same dispenser when closed. Adjacent to the closure member 5 the information for use 11 is fixed on the cover plate 8.

Figure 6:
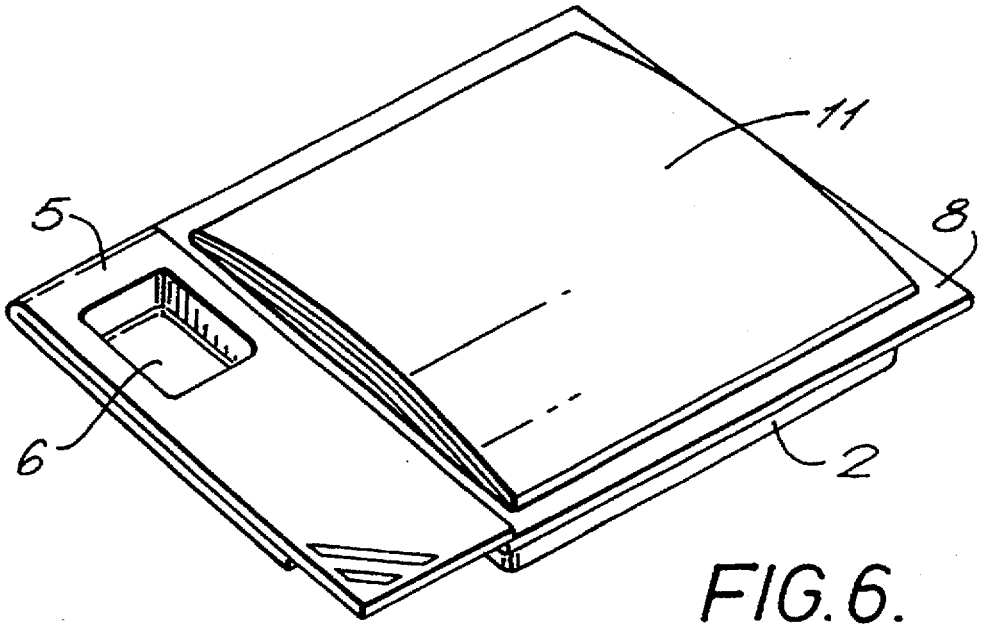
Figure 7:
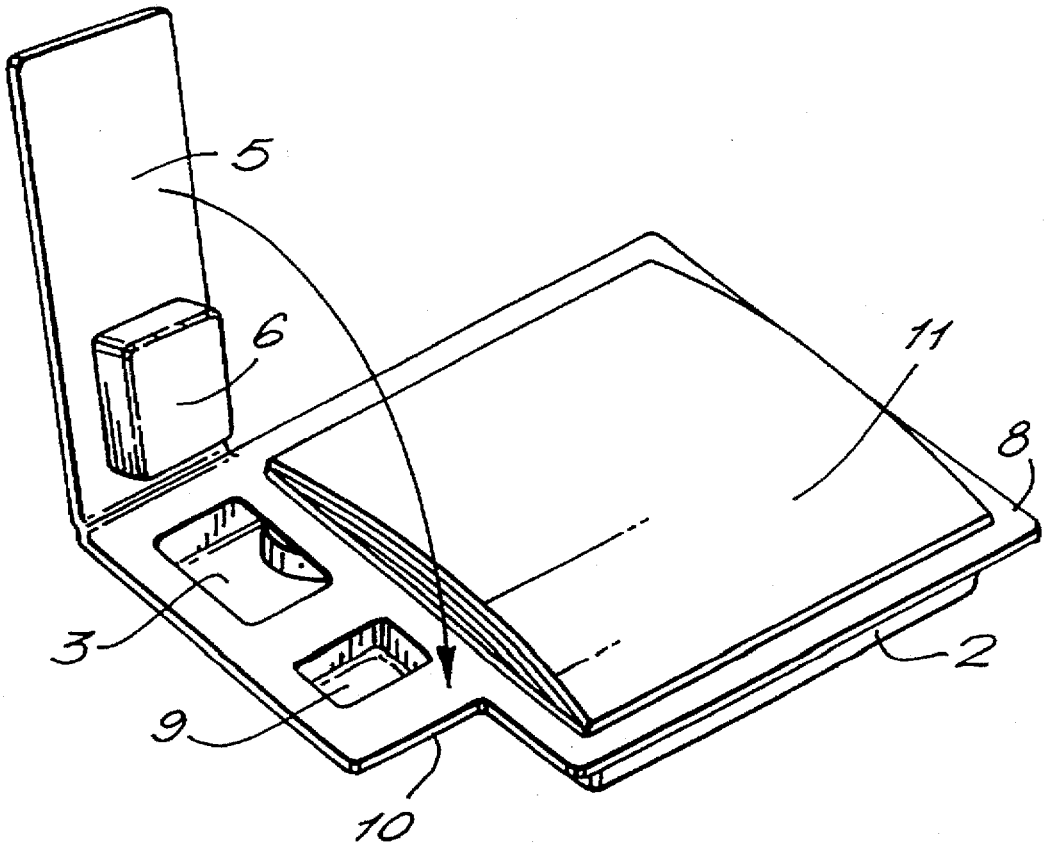

FIGS. 6 and 7 show a dispenser similar to that in FIGS. 4 and 5 viewed diagonally from above.

DESCRIPTION OF THE INVENTION

Dispensers according to the present invention are conveniently manufactured according to known methods of plastics processing. The dispensers usefully have a manufacturer's seal, known per se, to show immediately whether the dispenser has been opened. The manufacturer's seal may, for example, consist of a removable covering film welded over the removal part, the covering film extending into the removal well 3 so that it does not interfere with the closing of the dispenser by the flipping round of the closure member 5. The covering film may extend over the entire cover plate, in which case a perforated strip is removed before use, this strip preferably being the same length and width as the closure member 5.

We claim:

1. A dispenser for dispensing a solid pharmaceutical preparation comprising:

a flat tray in a base plate, the tray having a narrow end which connects to a removal well, a closure member attached to the base plate, having a convexity that engages in the removal well in the closed position, and a cover plate with a cutout allowing the convexity to pass through it.

2. The dispenser according to claim 1, wherein the base plate has a recess located so that it is covered when the closure member is in the closed position.

3. The dispenser according to claim 1 or 2, wherein a second recess is located in the base plate, the second recess being adjacent to the removal well and covered when the closure member is in the closed position.

4. The dispenser according to claim 3, wherein the removal well is sealed with a covering film.

* * * * *